US012152576B2

(12) United States Patent
Ahn et al.

(10) Patent No.: US 12,152,576 B2
(45) Date of Patent: Nov. 26, 2024

(54) SWASH PLATE COMPRESSOR

(71) Applicant: Hanon Systems, Daejeon (KR)

(72) Inventors: Hew Nam Ahn, Daejeon (KR); Bok Ki Park, Daejeon (KR); Eun Gi Son, Daejeon (KR); Je Su Yun, Daejeon (KR); You Cheol Jeong, Daejeon (KR)

(73) Assignee: Hanon Systems, Daejeon (KR)

( * ) Notice: Subject to any disclaimer, the term of this patent is extended or adjusted under 35 U.S.C. 154(b) by 545 days.

(21) Appl. No.: 17/510,706

(22) Filed: Oct. 26, 2021

(65) Prior Publication Data

US 2022/0042503 A1 Feb. 10, 2022

Related U.S. Application Data

(63) Continuation-in-part of application No. 16/315,825, filed as application No. PCT/KR2018/001936 on Feb. 14, 2018, now Pat. No. 11,187,219.

(30) Foreign Application Priority Data

Feb. 17, 2017 (KR) ..... 10-2017-0021494
Feb. 13, 2018 (KR) ..... 10-2018-0017436

(51) Int. Cl.
*F04B 39/10* (2006.01)
*F04B 27/10* (2006.01)

(52) U.S. Cl.
CPC ..... *F04B 39/1066* (2013.01); *F04B 27/1054* (2013.01); *F04B 27/1081* (2013.01); *F04B 39/1086* (2013.01)

(58) Field of Classification Search
CPC .. F04B 1/12–1/328; F04B 27/08–27/22; F04B 39/1066; F04B 39/108;
(Continued)

(56) References Cited

U.S. PATENT DOCUMENTS 4,098,296 A 7/1978 Grasso et al.
4,867,649 A * 9/1989 Kawashima ..... F04B 27/1804 417/270

(Continued)

FOREIGN PATENT DOCUMENTS

JP 2000199479 A 7/2000
JP 2008184926 A 8/2008

(Continued)

*Primary Examiner* — Philip E Stimpert
*Assistant Examiner* — Dnyanesh G Kasture
(74) *Attorney, Agent, or Firm* — Norton Rose Fulbright US LLP; James R. Crawford

(57) ABSTRACT

A swash plate compressor including a cylinder block accommodating a piston for compressing a refrigerant, a front housing coupled to the front of the cylinder block and having a crank chamber, a rear housing having a suction chamber and a discharge chamber and coupled to the rear of the cylinder block. The swash plate compressor includes a valve assembly with a valve plate inserted into the rear housing, a gasket in the cylinder block, a suction plate between the valve plate and the cylinder block, a variable orifice module having a first orifice hole for refrigerant passing, a second orifice hole communicating with the suction chamber to discharge the refrigerant passing through the first orifice hole to the suction chamber, and an intermediate passage connecting the orifice holes, the first orifice hole having a variable reed, a degree of opening of which is varied depending on the refrigerant pressure.

12 Claims, 18 Drawing Sheets

(58) Field of Classification Search
CPC .. F04B 49/002; F04B 35/002; F04B 27/1804; F04B 39/1073; F04B 39/1086; F04B 2027/1868; F04B 39/10; F04B 2027/1822; F04B 2027/1831; F04B 2027/1845; F01B 3/0008; F16K 15/1402
USPC ..... 417/270, 222.2; 91/504–506; 137/855
See application file for complete search history.

(56) References Cited

U.S. PATENT DOCUMENTS 5,261,448 A 11/1993 Furuya et al.
5,406,976 A 4/1995 Bekki
5,654,512 A 8/1997 Harnett et al.
6,139,291 A * 10/2000 Perevozchikov ..... F04C 29/128 137/856
6,290,468 B1 * 9/2001 Kato ..... F04B 27/1804 91/473
6,540,488 B2 4/2003 Takai et al.
7,632,077 B2 12/2009 Tagami
11,187,219 B2 * 11/2021 Ahn ..... F04B 39/108
2007/0217923 A1 9/2007 Warren et al.
2008/0317584 A1 * 12/2008 Murase ..... F04B 27/109 415/230
2009/0116971 A1 * 5/2009 Ozeki ..... F04B 49/24 417/269
2009/0223244 A1 9/2009 Kimoto et al.
2015/0252797 A1 * 9/2015 Taguchi ..... F04B 27/14 417/218

FOREIGN PATENT DOCUMENTS

KR 20080055117 A 6/2008
KR 20110053743 A 5/2011
KR 20120100189 A 9/2012
KR 20150005762 A 1/2015
KR 20160041128 A 4/2016

* cited by examiner

SWASH PLATE COMPRESSOR

CROSS REFERENCE TO RELATED APPLICATIONS

The present application is a continuation-in-part of U.S. patent application Ser. No. 16/315,825 filed Jan. 7, 2019, allowed, which is a national phase under 35 U.S.C. § 371 of International Application No. PCT/KR2018/001936 filed Feb. 14, 2018, which claims the benefit of priority from Korean Patent Application Nos. 10-2017-0021494 filed Feb. 17, 2017, and 10-2018-0017436 filed Feb. 13, 2018, the entire contents of each of which is incorporated herein by reference in its entirety.

TECHNICAL FIELD

The present disclosure relates to a swash plate compressor, and more particularly, to a swash plate compressor capable of having improved efficiency by preventing an unnecessary loss of refrigerant gas.

BACKGROUND ART

In general, a compressor applied to air conditioning systems sucks refrigerant gas having passed through an evaporator to compress it to high temperature and high pressure, and then discharges the compressed refrigerant gas to a condenser. There are used various types of compressors such as a reciprocating compressor, a rotary compressor, a scroll compressor, and a swash plate compressor.

Among these compressors, the compressor using an electric motor as a power source is typically referred to as an electric compressor, and a swash plate compressor is widely used in air conditioning systems for vehicles.

The swash plate compressor includes a disk-shaped swash plate that is obliquely installed to a drive shaft rotated by the power transmitted from an engine to be rotated by the drive shaft. The principle of the swash plate compressor is to suck or compress and discharge refrigerant gas by rectilinearly reciprocating a plurality of pistons within cylinders along with the rotation of the swash plate. In particular, the variable capacity-type swash plate compressor disclosed in Korean Patent Application Publication No. 2012-0100189 includes a swash plate having a variable angle of inclination and regulates the discharge rate of refrigerant in such a manner that the feed rate of a piston is changed while the angle of inclination of the swash plate is varied.

The angle of inclination of the swash plate may be controlled using the pressure Pc in a control chamber (crank chamber). Specifically, the pressure in the control chamber may be regulated by introducing a portion of the compressed refrigerant discharged to a discharge chamber into the control chamber, and the angle of inclination of the swash plate is changed depending on the pressure Pc in the control chamber.

Here, since the refrigerant leaked between a piston and a cylinder is also introduced into the control chamber as well as the discharge chamber, it is necessary to discharge the introduced refrigerant to a suction chamber to keep a proper pressure. To this end, the variable capacity-type swash plate compressor has an orifice hole for communication between the control chamber and the suction chamber, and the refrigerant in the control chamber is reintroduced into the suction chamber through the orifice hole.

Since the efficiency of the compressor is decreased as the amount of refrigerant discharged through the orifice hole is increased, it is necessary to minimize this issue.

However, the conventional variable capacity-type swash plate compressor has a problem in that the efficiency of the compressor is reduced since refrigerant gas is lost through the orifice hole even when the difference between control pressure and suction pressure is kept constant.

DISCLOSURE

Technical Problem

It is an object of the present disclosure to provide a swash plate compressor capable of having improved efficiency by preventing an unnecessary loss of refrigerant gas.

Technical Solution

To accomplish the above-mentioned object, in accordance with an aspect of the present disclosure, there is provided a swash plate compressor including a cylinder block accommodating a piston for compressing a refrigerant, a front housing coupled to the front of the cylinder block and having a crank chamber, and a rear housing having a suction chamber and a discharge chamber and coupled to the rear of the cylinder block.

The swash plate compressor includes a valve assembly including a valve plate inserted into the rear housing, a gasket inserted into the cylinder block, and a suction plate inserted between the valve plate and the cylinder block, and a variable orifice module including a first orifice hole through which the refrigerant in the crank chamber passes, a second orifice hole communicating with the suction chamber to discharge the refrigerant passing through the first orifice hole to the suction chamber, and an intermediate passage interconnecting the first and second orifice holes, the first orifice hole having a variable reed, a degree of opening of which is varied depending on the pressure of the refrigerant.

The cylinder block may have a through-portion (100*a*) formed thereon and extending between the crank chamber and the first orifice hole.

The variable reed may be configured such that one end thereof is formed integrally with the suction plate and the other end thereof is formed as a free end. When the pressure of the refrigerant rises above a predetermined value, the free end may be displaced to enlarge the degree of opening of the first orifice hole.

The first orifice hole may be formed on the suction plate.

In addition, the first orifice hole may be formed along at least a portion of an outer peripheral portion of the variable reed. That is, the variable reed may be disposed to cover only a portion of the first orifice hole without covering the entirety thereof.

In addition, the first orifice hole may further include a reed hole formed through the variable reed.

The intermediate passage may include a reed groove recessed from the valve plate. The reed groove may serve to form a portion of a passage in which the refrigerant passing through the first orifice hole flows and simultaneously to limit the displacement of the variable reed.

The second orifice hole may be formed through the valve plate and at any position that communicates with the suction chamber. For example, the second orifice hole may be at the substantial center of the valve plate.

The intermediate passage may include a buffer space communicating with the reed groove. The buffer space may be disposed at the substantial center of the cylinder block and also connected to the second orifice hole. That is, when there is provided the buffer space, the flow path of the refrigerant may be formed in the order of the first orifice hole→the reed groove→the buffer space→the second orifice hole→the suction chamber.

The buffer space can minimize an increase in flow resistance, an occurrence of noise, and the like which may be caused when the high-pressure refrigerant is instantaneously introduced into the small reed groove immediately after the pressure of the refrigerant is increased and the variable reed is opened.

In accordance with another aspect of the present disclosure, there is provided a swash plate compressor including a cylinder block accommodating a piston for compressing a refrigerant, a front housing coupled to the front of the cylinder block and having a crank chamber, and a rear housing having a suction chamber and a discharge chamber and coupled to the rear of the cylinder block. The swash plate compressor includes a valve assembly including a valve plate inserted into the rear housing, and a suction plate inserted between the valve plate and the cylinder block, and a variable orifice module including a first orifice hole through which the refrigerant in the crank chamber passes, a second orifice hole communicating with the suction chamber to discharge the refrigerant passing through the first orifice hole to the suction chamber and formed in the valve plate, and a reed groove formed in the valve plate and interconnecting the first and second orifice holes, the first orifice hole having a variable reed, a degree of opening of which is varied depending on the pressure of the refrigerant.

The variable reed may be configured such that one end thereof is formed integrally with the suction plate and the other end thereof extends as a free end, and the variable reed may be displaced into the reed groove. In addition, the variable reed may be configured such that one end thereof is formed integrally with the suction plate and the other end thereof extends as a free end, and the variable reed may be displaced into the reed groove as described above. In addition, the first orifice hole may be disposed to cover at least a portion of an outer peripheral portion of the variable reed.

As described above, the cylinder block may have a through-portion extending between the crank chamber and the first orifice hole.

In addition, a hollow passage may be formed inside a drive shaft mounted to the cylinder block, and the refrigerant may be introduced through the hollow passage into the first orifice hole.

In this case, a buffer space may be defined between the hollow passage and the first orifice hole. The buffer space may be disposed at the substantial center of the cylinder block. In some cases, both of the through-portion and the hollow passage may be formed, in which case the refrigerant may individually flow through the through-portion and the hollow passage and then join at the upstream side of the first orifice hole to be discharged to the suction chamber.

Advantageous Effects

A swash plate compressor according to exemplary embodiments of the present disclosure can prevent an unnecessary outflow of refrigerant gas when the difference between control pressure and suction pressure is kept constant by opening and closing an orifice hole, adding a reed for varying the flow rate of refrigerant in the orifice hole, or varying a passage. Since the loss of refrigerant gas is reduced, the efficiency of the compressor can be improved.

BEST MODE FOR INVENTION

Hereinafter, a swash plate compressor according to exemplary embodiments of the present disclosure will be described in detail with reference to the accompanying drawings.

Figure 1:
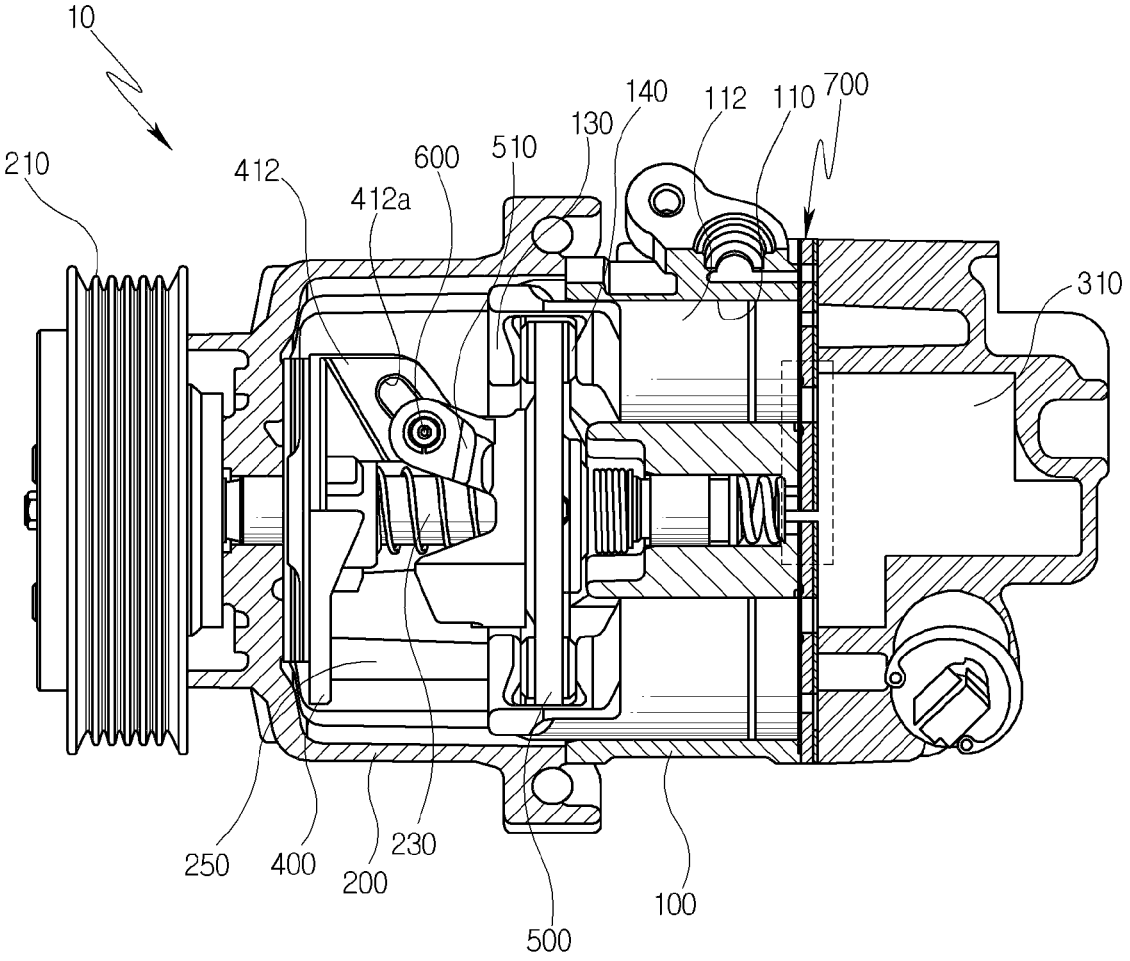
FIG. 1 is a cross-sectional view illustrating an example of a swash plate compressor.

FIG. 1 is a cross-sectional view illustrating an example of a swash plate compressor.

Figure 2:
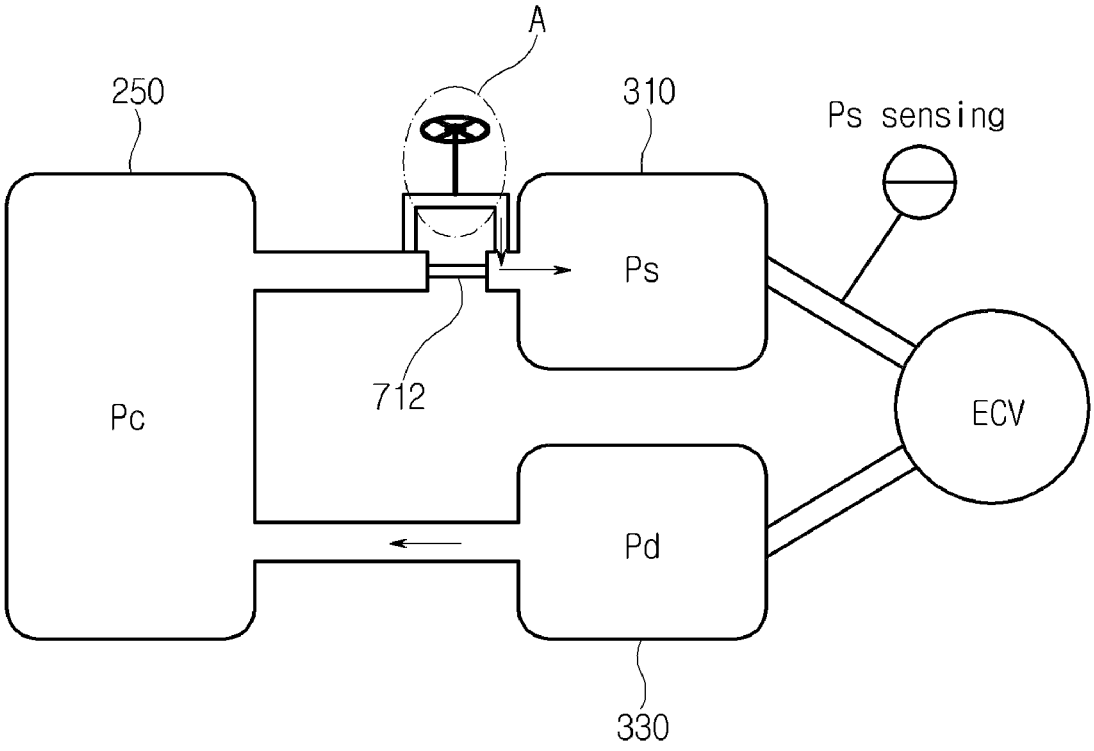
FIG. 2 is a diagram illustrating a pressure flow in the swash plate compressor of FIG. 1.

FIG. 2 is a diagram illustrating a pressure flow in the swash plate compressor of FIG. 1.

As illustrated in FIGS. 1 and 2, a variable swash plate compressor 10 includes a cylinder block 100 defining the external appearance thereof, a front housing 200 coupled to the front of the cylinder block 100, a rear housing 300 coupled to the rear of the cylinder block 100, and a drive unit provided inside them.

The drive unit includes a pulley 210 supplied with power from an engine, a drive shaft 230 rotatably installed to the center of the front housing 200 to be coupled with the pulley 210, a rotor 400 coupled on the drive shaft 230, and a swash plate 500. The cylinder block 100 includes a plurality of cylinder bores 110 arranged in the circumferential direction thereof, and a piston 112 is inserted into each of the cylinder bores 110.

The piston 112 is connected to a connection part 130 having a pair of hemispherical shoes 140 therein. The swash plate 500 is installed in such a manner that a portion of the outer periphery thereof is inserted between the shoes 140, and the outer periphery of the swash plate 500 passes through the shoes 140 while the swash plate 500 rotates.

Since the swash plate 500 is driven with an inclination at a certain angle with respect to the drive shaft 230, the shoes 140 and the connection part 130 rectilinearly reciprocate by the inclination of the swash plate 500 in the cylinder block 100. In addition, the piston 112 rectilinearly reciprocates to move forward and rearward longitudinally in the cylinder bore 110 according to the movement of the connection part 130, and refrigerant gas is compressed along with the reciprocation of the piston 112.

The swash plate 500 is rotatably coupled to the rotor 400 by a hinge 600 in the state in which it is inserted into the drive shaft 230, and a spring (no reference numeral) is provided between the swash plate 500 and the rotor 400 to elastically support the swash plate 500. Since the swash plate 500 is rotatably coupled to the rotor 400, the swash plate 500 also rotates along with the rotation of the drive shaft 230 and the rotor 400.

The rear housing 300 includes a control valve (not shown), a suction chamber 310 into which a refrigerant is sucked, and a discharge chamber 330 from which a refrigerant is discharged, and a valve assembly 700 is installed between the rear housing 300 and a crank chamber 250. A discharge assembly 800 is provided at the rear end of the valve assembly 700.

The refrigerant gas in the suction chamber 310 is sucked into the cylinder bore 110, and the refrigerant gas compressed by the piston 112 is discharged to the discharge chamber 330. The valve assembly 700 allows the discharge chamber 330, from which the refrigerant is discharged, to communicate with the crank chamber 250 defined in the front housing 200, and regulates the discharge rate and pressure of refrigerant by changing the difference between the refrigerant suction pressure in the cylinder bore 110 and the gas pressure in the crank chamber 250 to adjust an angle of inclination of the swash plate 500.

The swash plate compressor includes a variable orifice module to prevent an unnecessary outflow of refrigerant when the difference between the control pressure Pc in the crank chamber 250 and the suction pressure Ps in the suction chamber 310 is kept constant (which will be described later).

When a cooling load is large, the pressure in the crank chamber 250 is controlled to decrease by the control valve, in which case the angle of inclination of the swash plate 500 is also increased. When the angle of inclination of the swash plate 500 is increased, the stroke of the piston is also increased and the discharge rate of refrigerant is thus increased.

On the contrary, when a cooling load is small, the pressure in the crank chamber 250 is controlled to increase by the control valve, in which case the angle of inclination of the swash plate 500 is also reduced so that the swash plate 500 becomes perpendicular to the drive shaft 230. When the angle of inclination of the swash plate 500 is reduced, the stroke of the piston is also decreased and the discharge rate of refrigerant is thus reduced. At the time of the initial operation of the compressor or to maximize a stroke length by increasing the angle of inclination of the swash plate 500, the pressure in the crank chamber 250 must be lowered. To this end, the typical swash plate compressor has an orifice hole to discharge the high-pressure refrigerant in the crank chamber 250 to the suction chamber. When the size of the orifice hole is large, a refrigerant can be rapidly discharged to the suction chamber, but even if unnecessary, the refrigerant may be lost.

That is, when the difference between the control pressure Pc which is the pressure in the crank chamber 250 and the suction pressure Ps which is the pressure in the suction chamber (hereinafter, referred to as the differential pressure between the crank chamber and the suction chamber) is increased, the refrigerant in the crank chamber 250 is introduced into the suction chamber 310. However, when the differential pressure between the crank chamber 250 and the suction chamber 310 is kept constant, a refrigerant may be discharged from the crank chamber 250 through the orifice hole to the suction chamber (see FIG. 2). Accordingly, in order to improve the efficiency of the compressor, it is necessary to minimize the amount of refrigerant discharged to the suction chamber through the orifice hole when the differential pressure between the crank chamber 250 and the suction chamber 310 is kept constant.

In addition, when the pressure in the crank chamber 250 rises above a certain pressure, the variable orifice module is opened by the pressure to move the refrigerant in the crank chamber 250 to the suction chamber 310, thereby lowering the pressure in the crank chamber 250.

The variable orifice module of the present disclosure includes two orifice holes, namely first and second orifice holes, and an intermediate passage that allows the first and second orifice holes to communicate with each other. The first orifice hole includes a variable reed to vary a degree of opening depending on the pressure of refrigerant. In addition, the intermediate passage may consist of a reed groove and a buffer space (first embodiment) or a single reed groove (second embodiment). In each embodiment, it is possible to adopt a variety of variable reeds. The refrigerant in the crank chamber may be introduced into the first orifice hole through a through-portion formed in the cylinder block or may be introduced through a hollow passage formed through the drive shaft.

Here, the hollow passage may be connected to the buffer space.

Figure 3:
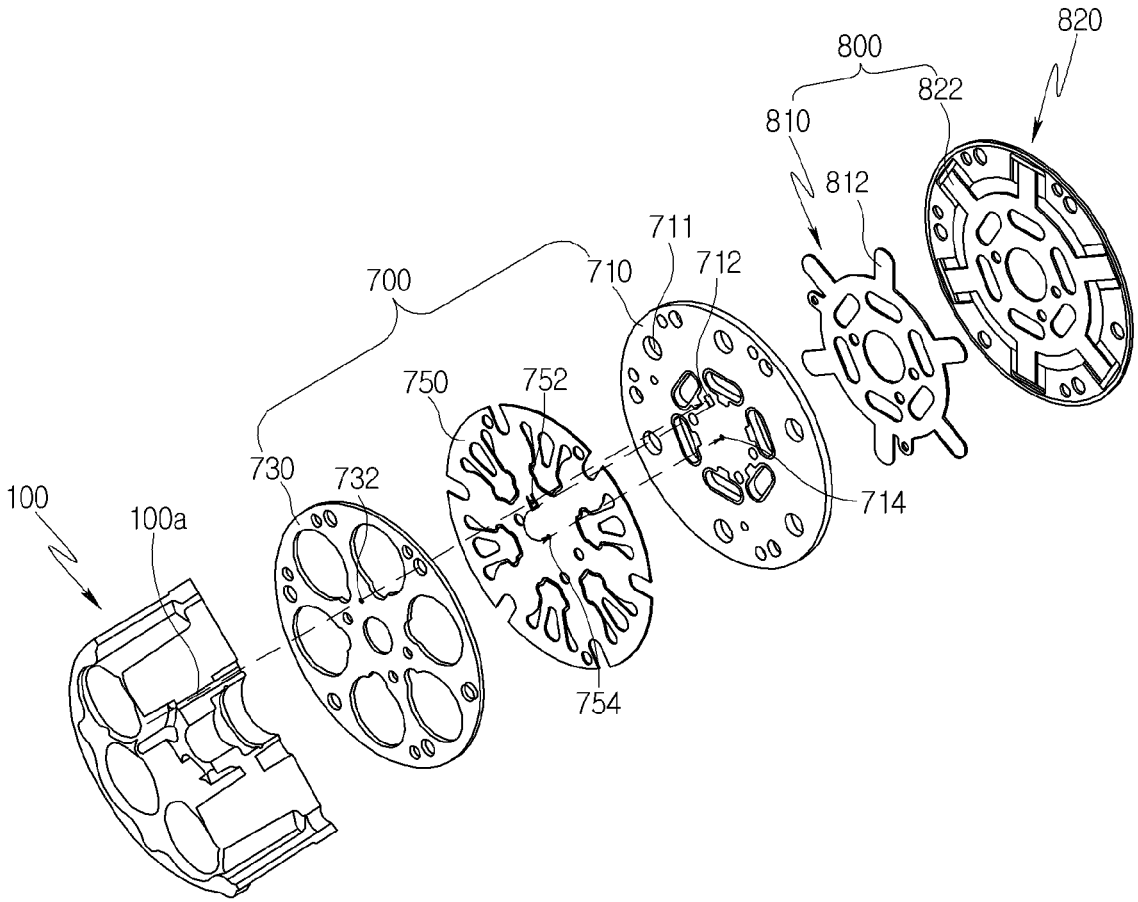
FIG. 3 is a perspective view illustrating a refrigerant passage of a swash plate compressor according to a first embodiment of the present disclosure.
Figure 4:
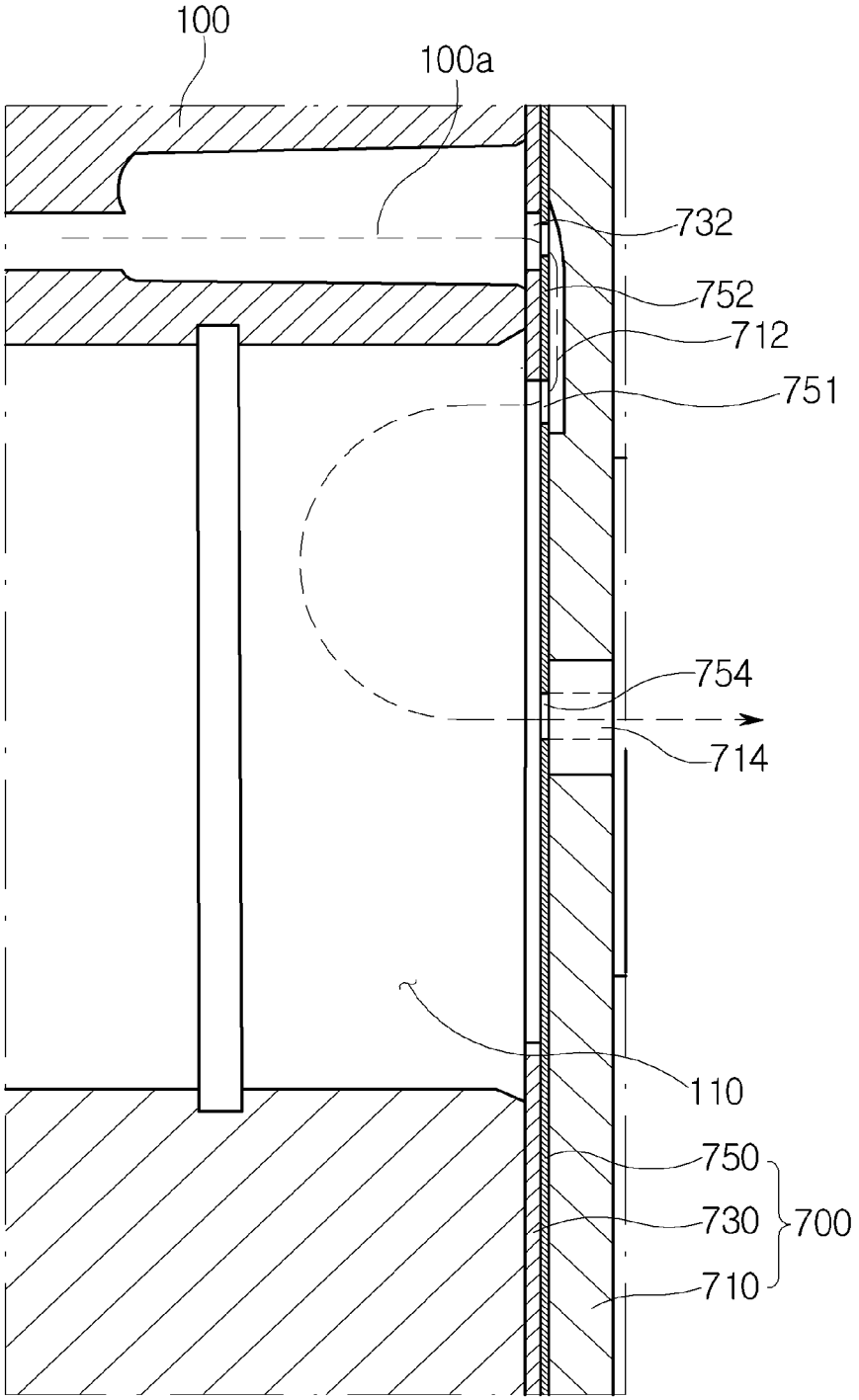
FIG. 4 is a cross-sectional view illustrating a main portion of the swash plate compressor of FIG. 3.
Figure 5:
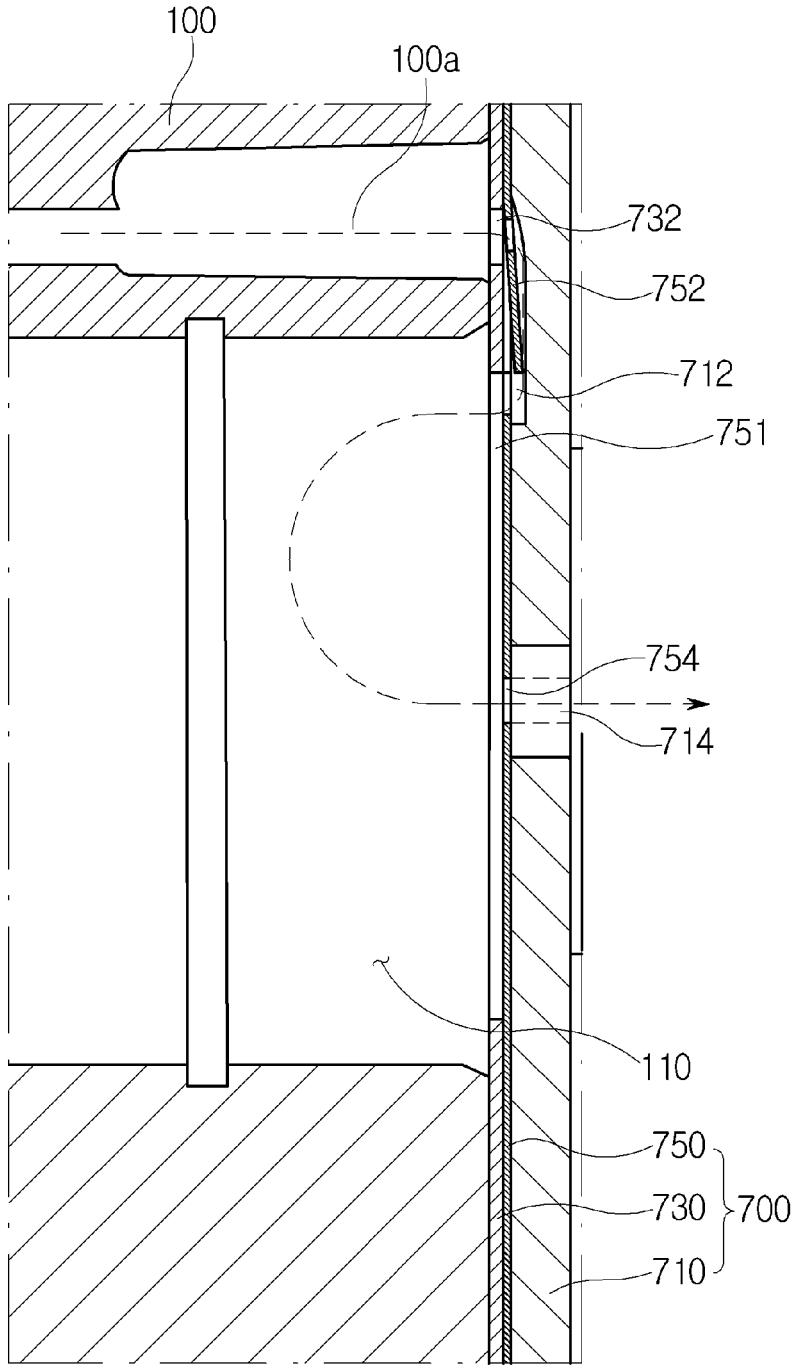
FIG. 5 is a cross-sectional view illustrating the refrigerant passage of FIG. 3 in FIG. 4.

FIG. 3 is a perspective view illustrating a refrigerant passage of a swash plate compressor according to a first embodiment of the present disclosure. FIG. 4 is a cross-sectional view illustrating a main portion of the swash plate compressor of FIG. 3. FIG. 5 is a cross-sectional view illustrating the refrigerant passage of FIG. 3 in FIG. 4.

As illustrated in FIGS. 3 and 4, a valve assembly 700 includes a valve plate 710 inserted into a rear housing 300, a gasket 730 inserted into a cylinder block 100, and a suction plate 750 inserted therebetween. A discharge assembly 800 includes a discharge reed 810 having a plurality of reed valves 812, each functioning as a discharge valve for guiding the refrigerant compressed in a cylinder to a discharge chamber 330 only when the pressure of the refrigerant is higher than a predetermined pressure, and a discharge gasket 820 having a retainer 822 formed to regulate an amount of movement of each of the reed valves 812.

The reed valves 812 provided in the discharge reed are arranged to face a plurality of discharge holes 711 formed in the valve plate 710. Thus, when the pressure of the refrigerant in the cylinder is sufficiently increased, the reed valves 812 are opened to discharge the refrigerant through the discharge holes to the discharge chamber.

On the basis of the flow of refrigerant, the cylinder block 100 has a through-portion 100*a* formed therethrough in the longitudinal direction of a drive shaft 230. The gasket 730 has a gasket hole 732 formed thereon corresponding to the position of the through-portion 100*a*, and the suction plate 750 has a variable reed 752 (which will be described later) formed thereon corresponding to the position of the gasket hole 732. The valve plate 710 has a reed groove 712 formed corresponding to the position of the variable reed 752. The valve plate 710 has a second orifice hole 714 formed therethrough to communicate with the suction chamber, and the suction plate 750 has a refrigerant hole 754 formed therethrough corresponding to the position of the second orifice hole 714.

The gasket hole 732 has a shape corresponding to the shape of the variable reed 752 and is formed through the gasket 730. The gasket hole 732 functions as a path through which the refrigerant introduced from the crank chamber primarily passes. However, the gasket hole 732 may have any shape such that the refrigerant is transferred to the variable reed 752.

The reed groove 712 is a type of accommodation space which is the flow space of the variable reed 752 when the variable reed 752 is deformed by the pressure of refrigerant to open the gasket hole 732 during the flow of the refrigerant. The reed groove 712 is recessed from the surface of the valve plate 710 and formed on the plate surface facing the suction plate 750. In addition, the reed groove 712 forms a portion of the intermediate passage for supplying a refrigerant to the second orifice hole and functions as a retainer for limiting the displacement of the variable reed 752. Accordingly, the reed groove 712 must have a shape enough to accommodate the variable reed 752 and the depth thereof may be appropriately selected according to the thickness of the variable reed and the type, working pressure, and flow rate of refrigerant to be supplied.

Figure 6:
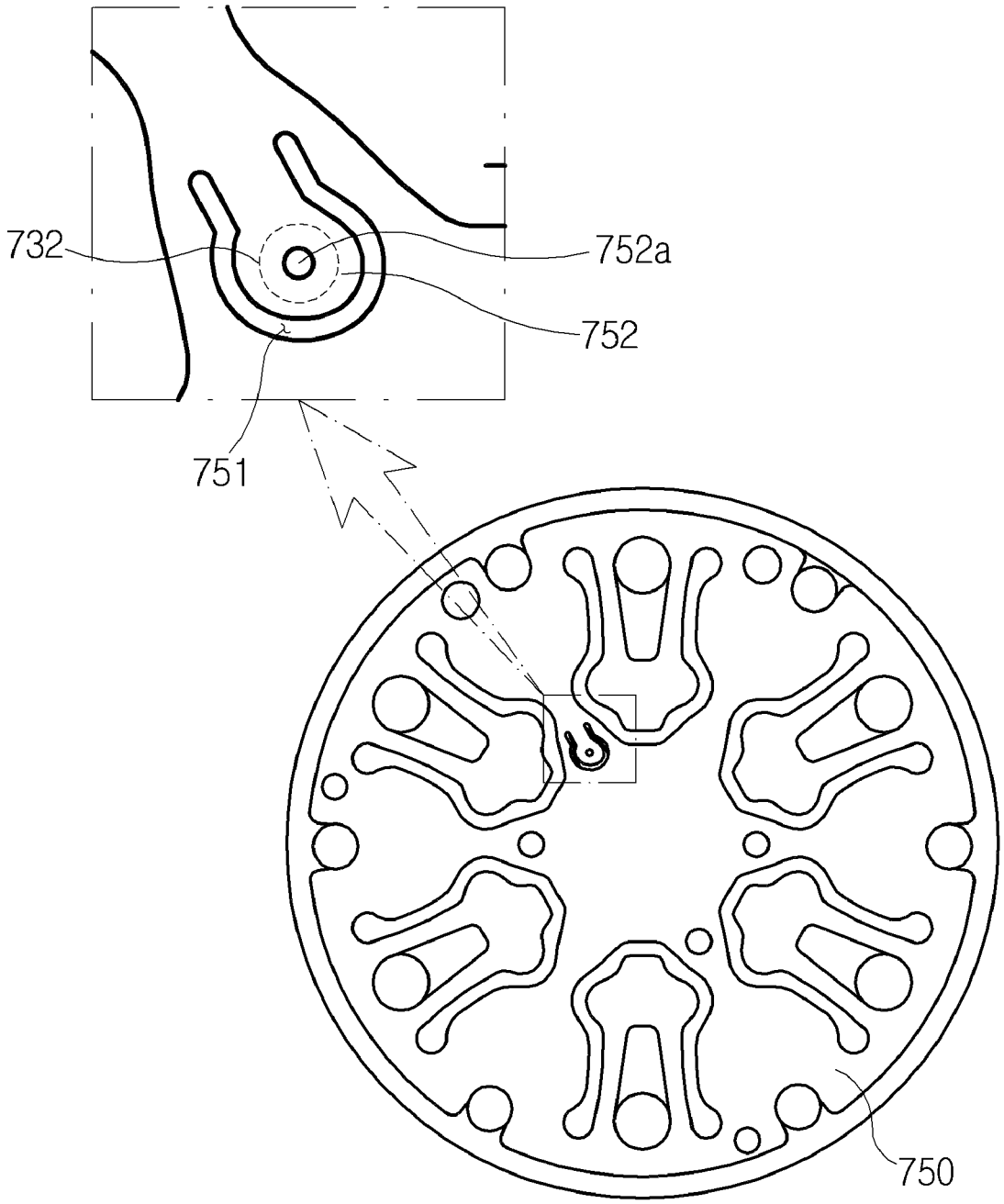
FIG. 6 is a view illustrating a first example of a variable reed applied to the swash plate compressor of FIG. 3 according to the present disclosure.

The first orifice hole 751 is defined as a space in which the variable reed 752 is disposed. Referring to FIG. 6, the first orifice hole 751 is formed by cutting a portion of the suction plate 750 and the variable reed 752 is disposed in the orifice hole 751. As seen from FIG. 6, since the first orifice hole 751 is larger than the variable reed 752, a certain amount of refrigerant always passes through the first orifice hole 751 regardless of whether the variable reed 752 is opened or closed.

The second orifice hole 714 is formed through the valve plate 710 and at a position corresponding to the center of rotation of the drive shaft 230. Here, the second orifice hole 714 need not necessarily be disposed at the center of rotation of the drive shaft 230, but may be disposed at any position that can communicate with the above-mentioned suction chamber. The refrigerant hole 754 is formed through the suction plate 750 at a position corresponding to the second orifice hole 714, which will be described later.

As illustrated in FIGS. 4 and 5, a refrigerant flows from the crank chamber 250 through the through-portion 100*a* formed in the cylinder block 100 and through the variable orifice module to the suction chamber 310.

A more detailed flow path is illustrated in FIGS. 3 to 5.

The refrigerant introduced into the crank chamber flows through the gasket hole 732 formed in the gasket 730 of the valve plate 710 and through the first orifice hole 751 formed in the suction plate 750 to the reed groove 712 of the valve plate 710. In this case, since the variable reed 752 disposed in the first orifice hole 751 is parallel with the surface of the suction plate, the first orifice hole 751 is formed along a portion of the outer peripheral portion of the variable reed 752.

The refrigerant introduced into the reed groove 712 flows toward the center of the valve plate along the reed groove 712 and then flows into a buffer space 110 defined at the substantial center of the cylinder block 100. The buffer space 110 is a space defined by one end of the cylinder block 100 and the valve assembly 700 and has a significantly larger capacity than the internal capacity of the reed groove 712.

Since the reed groove 712 extends from the first orifice hole 751 to the outer peripheral portion of the buffer space, the refrigerant flowing out of the reed groove 712 may be introduced into the buffer space 110. The buffer space 110 communicates with the second orifice hole 714. Since the second orifice hole 714 is also connected to the suction chamber 310, the refrigerant introduced into the buffer space 110 is consequently introduced into the suction chamber through the second orifice hole 714. In order to smoothly introduce the refrigerant into the second orifice hole 714, the refrigerant hole 754 is formed at a position facing the second orifice hole 714.

If the pressure in the crank chamber rises above a predetermined value, the variable reed 752 is displaced into the reed groove 712 by the pressure of refrigerant. FIG. 5 illustrates a state in which the variable reed 752 is displaced into the reed groove, in which case the flow path of the refrigerant is the same as that illustrated in FIG. 4.

However, since the degree of opening of the first orifice hole 751 is enlarged as compared with the case of FIG. 4, the flow rate of the refrigerant is increased so that the pressure in the crank chamber can be reduced more quickly.

When the pressure of refrigerant is lowered during the discharge of the refrigerant, the variable reed is returned back to the original position and the degree of opening of the first orifice hole 751 is reduced again. As a result, it is possible to reduce the flow rate of the refrigerant discharged to the suction chamber through the orifice hole, thereby increasing the efficiency of the compressor. Here, the ratio between the minimum open area and the maximum open area may be arbitrarily set according to the operating condition of the compressor.

The buffer space 110 has a very larger capacity then the capacity of the reed groove as described above. Accordingly, the refrigerant flowing to the buffer space through the reed groove is expanded, so that the pressure of the refrigerant can be lowered even though the refrigerant is not discharged to the suction chamber. Moreover, when the refrigerant is excessively discharged to the suction chamber, the suction pressure increases, which may also cause a deterioration in efficiency, but by providing the buffer space, it is possible to reduce an excessive increase in pressure inside the suction chamber. In addition, since the pressure of the refrigerant flowing through the reed groove immediately after the variable reed is displaced is rapidly increased, it may cause issues such as an occurrence of noise or an increase in flow resistance. However, these issues can be resolved by the buffer space.

Figure 7:
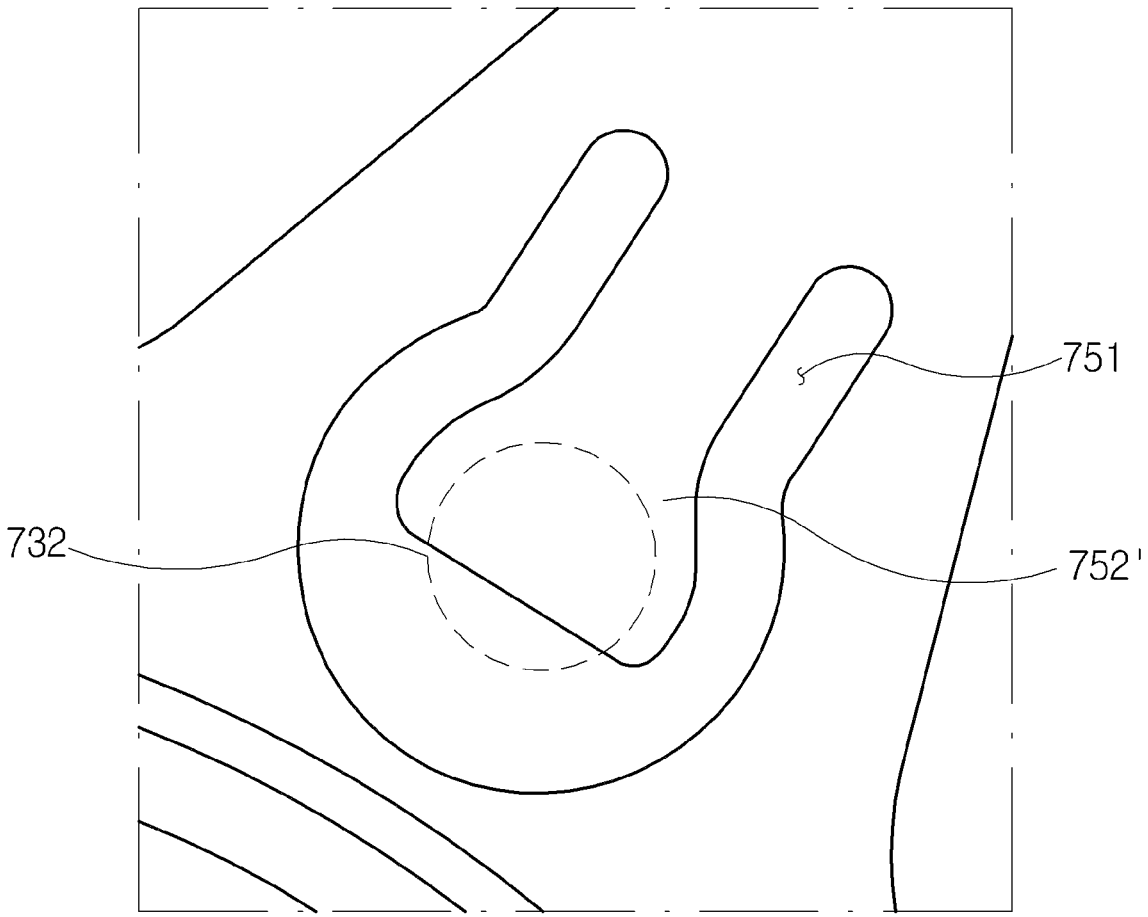
FIG. 7 is a view illustrating a second example of a variable reed applied to the swash plate compressor of FIG. 3 according to the present disclosure.
Figure 8:
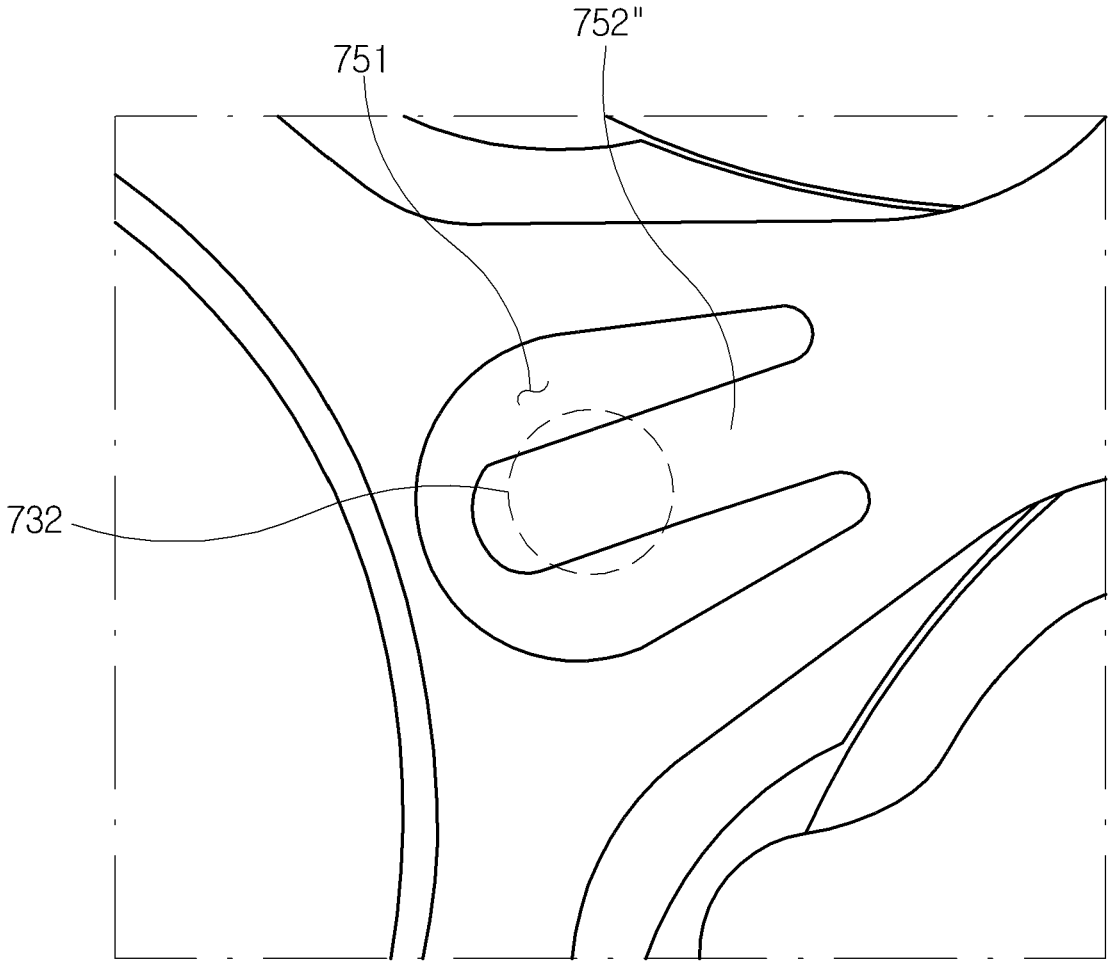
FIG. 8 is a view illustrating a third example of a variable reed applied to the swash plate compressor of FIG. 3 according to the present disclosure.

FIG. 6 is a view illustrating a first example of a variable reed applied to the swash plate compressor of FIG. 3 according to the present disclosure. FIG. 7 is a view illustrating a second example of a variable reed applied to the swash plate compressor of FIG. 3 according to the present disclosure. FIG. 8 is a view illustrating a third example of a variable reed applied to the swash plate compressor of FIG. 3 according to the present disclosure.

The above-mentioned variable reed 752 is opened toward the reed groove 712 at a predetermined pressure or more and partially closes the first orifice hole 751 communicating with the through-portion 100*a* at the predetermined pressure or less to reduce an orifice passage communicating with the crank chamber 250 and the suction chamber 310. The variable reed 752 is opened when the pressure in the crank chamber 250 rises, and the variable reed 752 has a reed hole 752*a* formed thereon or partially opens the passage.

As illustrated in FIG. 6, one end of the variable reed 752 is formed integrally with the suction plate 750 and the other end thereof extends to form a free end typically having a circular shape. Here, the free end has a greater diameter than the width of the fixed end, but is smaller than the width of the reed groove as the variable reed 752 is displaced into the reed groove 712. In FIG. 6, the reed hole 752*a* is formed at the free end of the variable reed 752, and the gasket hole 732 is smaller than the area of the variable reed 752. Accordingly, since the gasket hole 732 is fully closed by the variable reed 752 when there is no reed hole 752*a*, the reed hole 752*a* is formed such that a partial refrigerant always flow. Since the reed hole 752*a* serves to reduce a pressure receiving area to which the pressure applied to the variable reed 752 is applied, it may affect the responsiveness of the variable reed. Therefore, it is possible to control the responsiveness of the variable reed by adjusting the position, number, and area of the reed hole(s) in consideration of the dimension and material of the variable reed.

Meanwhile, the reed hole 752*a* may be removed in some cases, in which case a portion of the gasket hole is always opened regardless of the position of the variable reed such that the variable reed does not fully the gasket hole. For example, as illustrated in FIG. 7, one end of a variable reed 752' is formed integrally with the suction plate 750 and the other end thereof extends to form a free end partially having a circular shape.

Moreover, the tip of the free end has a rectilinear shape such that a portion of the gasket hole 732 is always kept opened regardless of the position of the variable reed.

Alternatively, as illustrated in FIG. 8, one end of a variable reed 752" is formed integrally with the suction plate 750 and the other end thereof may be a free end extending in a bar shape. In this case, the variable reed 752" has a smaller width than the gasket hole 732 so that a refrigerant may flow to the first orifice hole through the left and right sides of the variable reed.

Next, among various embodiments of the present disclosure, a description will be given of a case where a fixed orifice hole is shifted toward a variable reed and formed on a reed groove.

Figure 9:
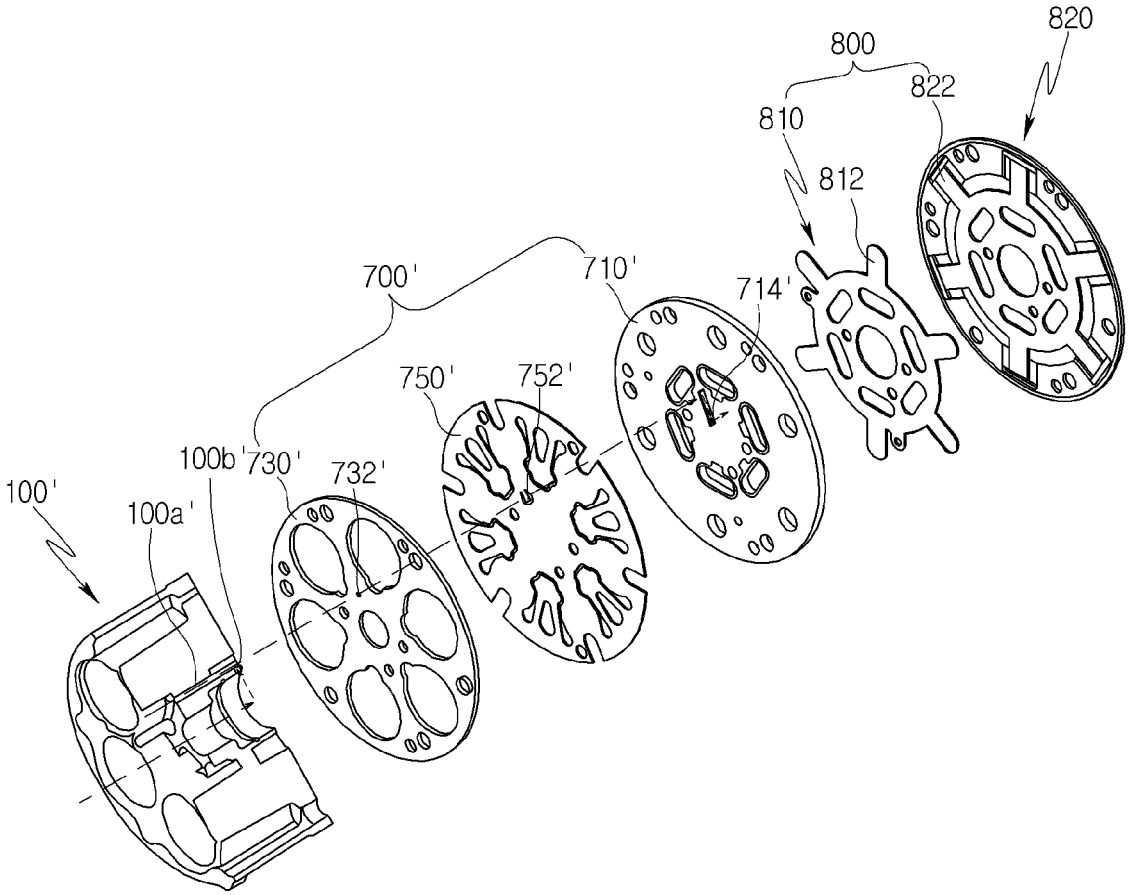
FIG. 9 is a perspective view illustrating a refrigerant passage of a swash plate compressor according to a second embodiment of the present disclosure.
Figure 10:
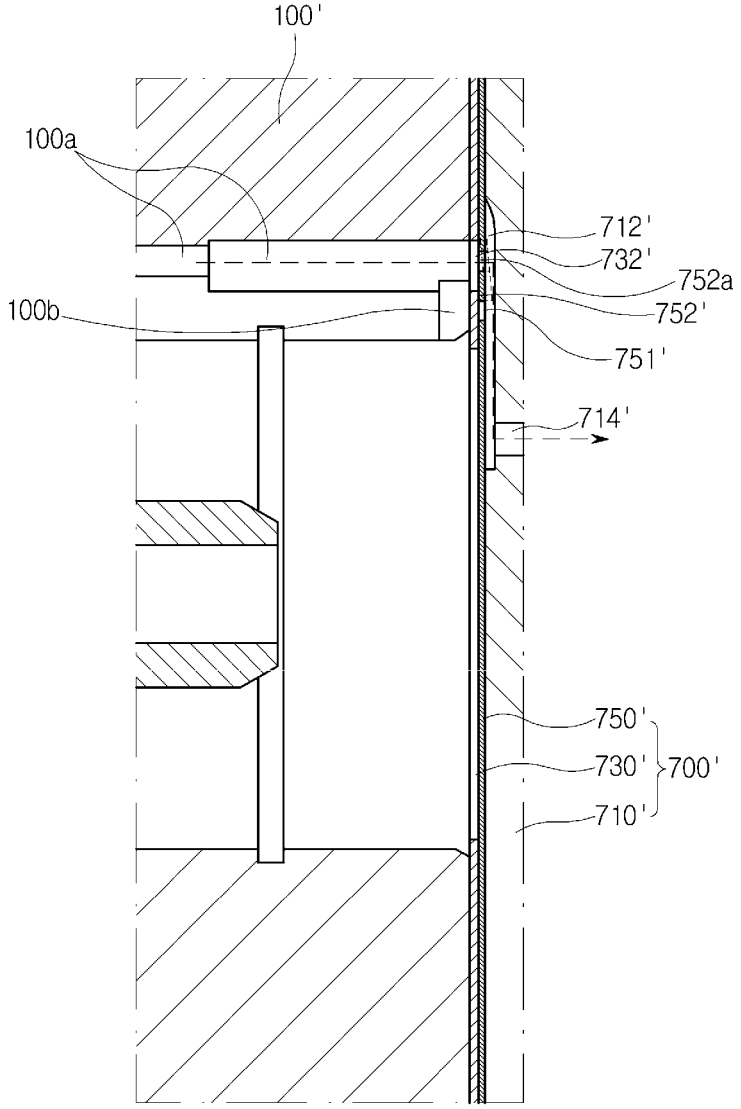
FIG. 10 is a cross-sectional view illustrating a main portion of the swash plate compressor of FIG. 9.
Figure 11:
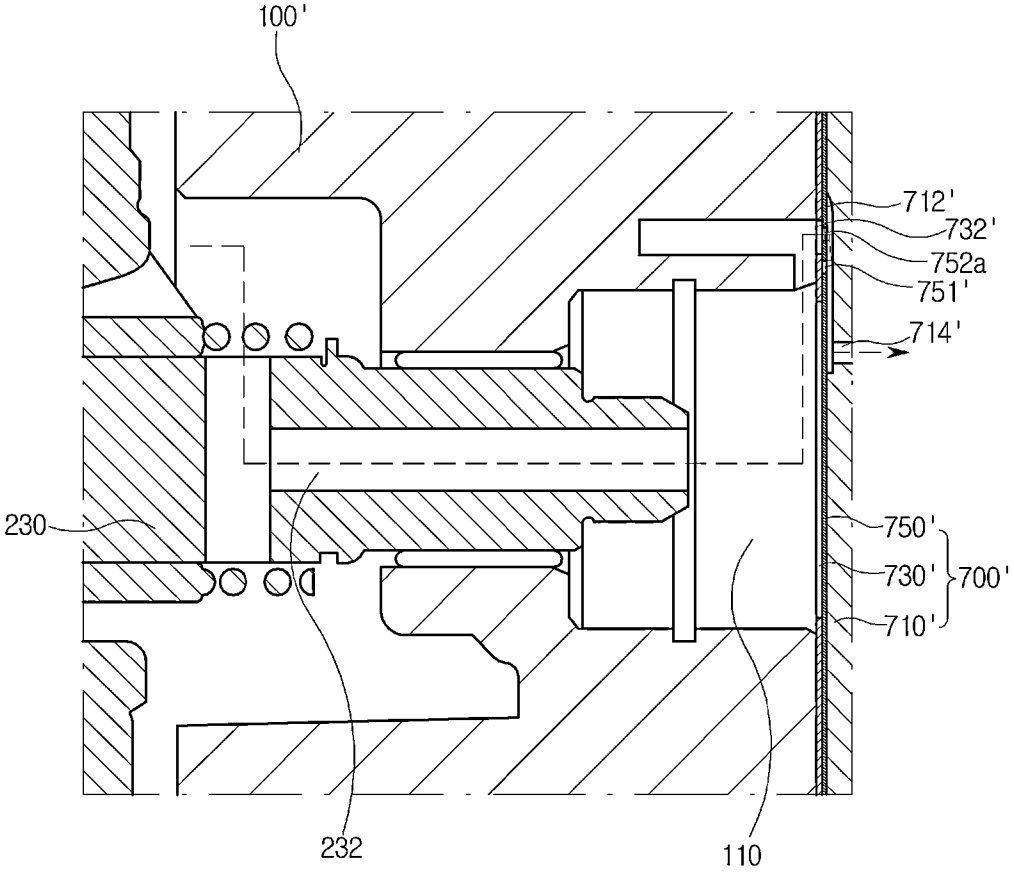
FIG. 11 is a cross-sectional view illustrating the refrigerant passage of FIG. 9 in FIG. 10.
Figure 12:
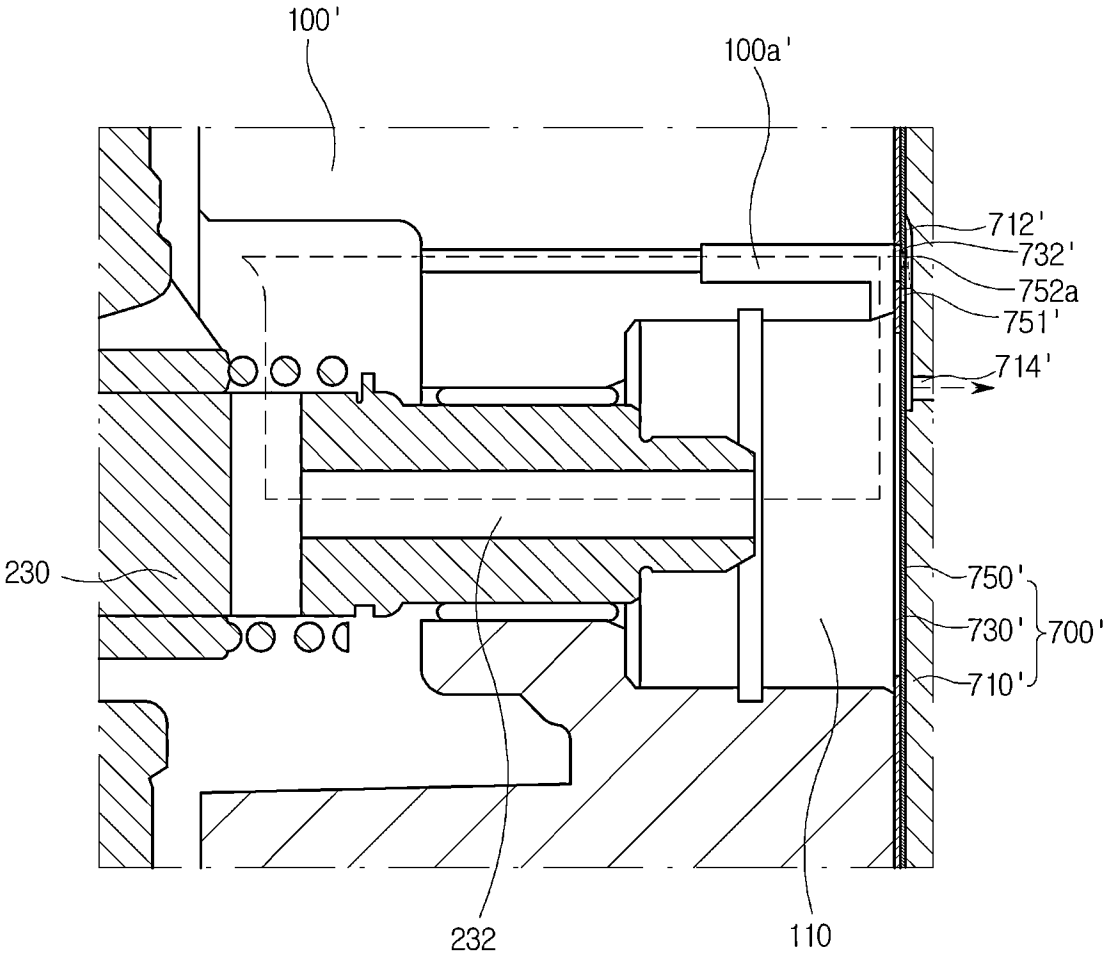
FIG. 12 is a cross-sectional view illustrating another example of the refrigerant passage of FIG. 9 in FIG. 10.

FIG. 9 is a perspective view illustrating a refrigerant passage of a swash plate compressor according to a second embodiment of the present disclosure. FIG. 10 is a cross-sectional view illustrating a main portion of the swash plate compressor of FIG. 9. FIG. 11 is a cross-sectional view illustrating the refrigerant passage of FIG. 9 in FIG. 10. FIG. 12 is a cross-sectional view illustrating another example of the refrigerant passage of FIG. 9 in FIG. 10.

As illustrated in FIGS. 9 and 10, a valve assembly 700' includes a valve plate 710' inserted into a rear housing 300, a gasket 730' inserted into a cylinder block 100', and a suction plate 750' inserted therebetween. A discharge assembly 800' includes a discharge reed 810' having a plurality of reed valves 812', each functioning as a discharge valve for guiding the refrigerant compressed in a cylinder to a discharge chamber 330 only when the pressure of the refrigerant is higher than a predetermined pressure, and a discharge gasket 820' having a retainer 822' formed to regulate an amount of movement of each of the reed valves 812'.

On the basis of the flow of refrigerant, the cylinder block 100' has a through-portion 100*a'* formed therethrough in the longitudinal direction of a drive shaft 230. In addition, the cylinder block 100' has a communication groove 100*b'* for communication from the through-portion 100*a'* to the drive shaft 230 to introduce the refrigerant flowing around the drive shaft 230. The gasket 730' has a gasket hole 732' formed thereon corresponding to the position of the through-portion 100*a'*, and the suction plate 750' has a variable reed 752' (which will be described later) formed thereon corresponding to the position of the gasket hole 732'. The valve plate 710' has a reed groove 712' formed corresponding to the position of the variable reed 752'. The valve plate 710' has an orifice hole 714' that is formed therethrough and corresponds to a fixed orifice hole, and the suction plate 750' has a refrigerant hole 754' formed therethrough corresponding to the position of the orifice hole 714'.

The gasket hole 732' has a circular shape at a position corresponding to the through-portion 100*a'*, and is formed through the gasket 730'. However, the gasket hole 732' may have any shape such that the refrigerant is transferred to the variable reed 752'.

The reed groove 712' is a type of accommodation space which is the flow space of the variable reed 752' when the variable reed 752' is deformed by the pressure of refrigerant to open the gasket hole 732' during the flow of the refrigerant. The reed groove 712' is recessed from the surface of the valve plate 710' and formed on the plate surface facing the suction plate 750'. In addition, the reed groove 712' forms a portion of the intermediate passage for supplying a refrigerant to the second orifice hole and functions as a retainer for limiting the displacement of the variable reed 752'. Accordingly, the reed groove 712' must have a shape enough to accommodate the variable reed 752' and the depth thereof may be appropriately selected according to the thickness of the variable reed and the type, working pressure, and flow rate of refrigerant to be supplied.

The first orifice hole 751' is defined as a space in which the variable reed 752' is disposed. Similar to the first orifice hole 751 of the first embodiment illustrated in FIG. 6, the first orifice hole 751' is formed by cutting a portion of the suction plate 750' and the variable reed 752' is disposed in the orifice hole 751'. As described above, since the variable reed 752' is larger than the gasket hole 732, the refrigerant flows through the reed hole 752*a* in the state in which the variable reed is closed, and it flows throughout the first orifice hole 751' in the state in which the variable reed is opened.

The second orifice hole 714' is formed through the reed groove 712' and at a position communicating with the suction chamber 310. Thus, a refrigerant discharge passage leading to the first orifice hole 751'→the reed groove 712'→the second orifice hole 714'→the suction chamber is defined. The operation of the variable reed 752' is the same as that of the above-mentioned first embodiment.

In the present embodiment, another refrigerant passage may be provided in addition to the passage illustrated in FIG. 10. Referring to FIG. 11, a hollow passage 232 is formed inside the drive shaft 230. The hollow passage 232 may be a portion of an oil discharge passage for discharge of the oil introduced into the crank chamber, and the refrigerant in the crank chamber may be thus introduced into the hollow passage 232. The refrigerant introduced into the hollow passage 232 is introduced into the same buffer space 110 as that of the first embodiment.

The refrigerant introduced into the buffer space 110 may be introduced into the first orifice hole 751' through the communication groove 100*b'* formed in the end of the cylinder block 100', and then introduced into the suction chamber through the refrigerant discharge passage as described above.

Meanwhile, the present disclosure may consider an example in which both of the passage illustrated in FIG. 10 and the passage illustrated in FIG. 11 are provided. Referring to FIG. 12, it can be seen that both of the through-portion 100*a'* and the hollow passage 232 are formed. Accordingly, a portion of the refrigerant in the crank chamber is introduced into the first orifice hole 751' through the through-portion 100*a'* and another portion thereof is introduced into the first orifice hole 751' through the hollow passage 232 and the communication groove 100*b'*.

Since the buffer space is disposed on the flow path of the refrigerant in both of the passages illustrated in FIGS. 11 and 12, it is possible to obtain the effect of the buffer space as described above. In particular, it is possible to more reduce the manufacture process since the existing oil separation passage may be used as a portion of the refrigerant discharge passage, and it is possible to more smoothly introduce the refrigerant in the crank chamber into the first orifice hole since the passage supplied with the refrigerant is further enlarged in FIG. 12.

Here, the variable reed 752' may utilize any of those illustrated in FIGS. 6 to 8.

Figure 13:
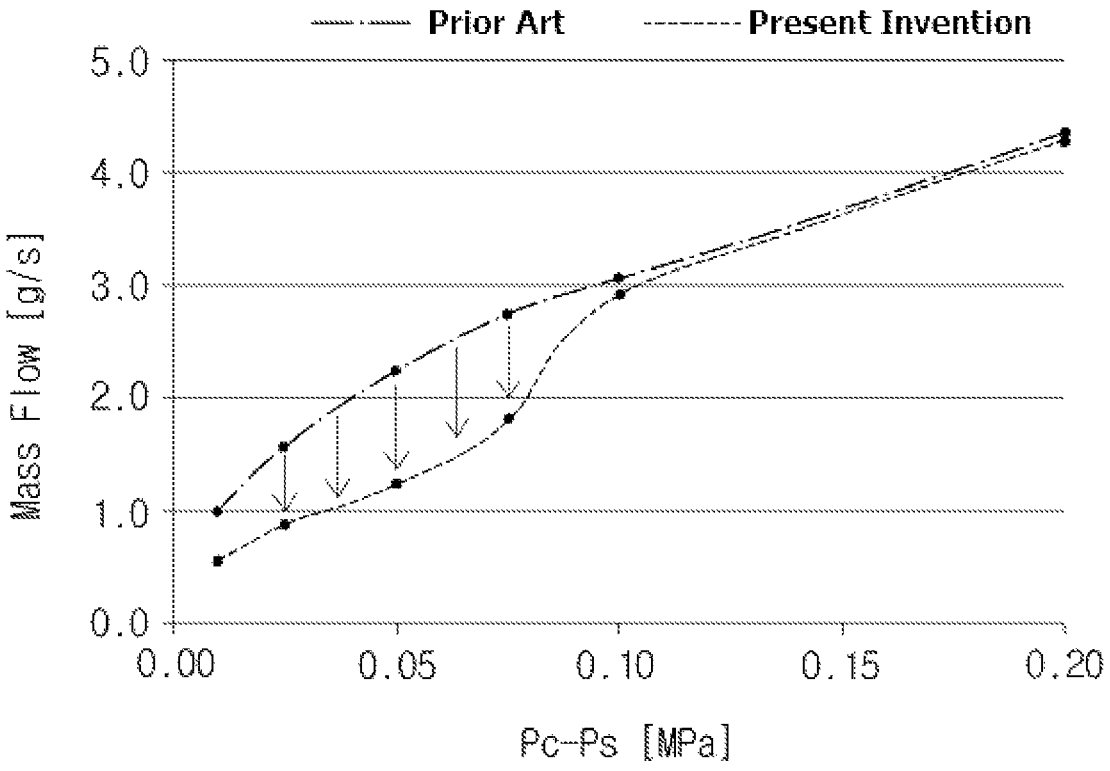
FIG. 13 is a graph illustrating a pressure control effect of the swash plate compressor according to the present disclosure.

FIG. 13 is a graph illustrating a pressure control effect of the swash plate compressor according to the present disclosure.

As illustrated in FIG. 13, in the conventional swash plate compressor, the amount of lost refrigerant gas is almost linearly increased as the difference between the control pressure Pc, which is the pressure in the crank chamber, and the suction pressure Ps, which is the pressure in the suction chamber, increases. However, in the present disclosure, it can be seen that the amount of the refrigerant gas lost when the difference between the control pressure Pc and the suction pressure Ps is 0.5 MPa is reduced to about 45%. In addition, it can be seen that the flow rate of the refrigerant discharged to the suction chamber is small up to 0.10 MPa at which the variable reed is fully opened, compared to the conventional compressor.

On the other hand, when the swash plate compressor of the above-described embodiments is manufactured together with the conventional swash plate compressor in a manufacturing line, manufacturing cost may be increased and a problem of erroneous assembly may occur due to the dual specifications of the suction plate and the valve plate. In consideration of this, as in an embodiment shown in FIGS. 14 to 18, the suction plate is formed as a common product, and only the valve plate may be formed to be dual.

Specifically, in a swash plate compressor according to another embodiment of the present disclosure shown in FIGS. 14 to 18, a suction plate 1750 may include a first orifice hole 1751 communicating with the crank chamber, a variable reed 1752 adjusting the opening amount of the first orifice hole 1751 and a third orifice hole 1754 communicating with the crank chamber and having a fixed opening amount.

And, the valve plate may include a first valve plate 1710 having a second orifice hole 1714 communicating with a suction chamber and a reed groove 1712 communicating the first orifice hole 1751 and the second orifice hole 1714.

In addition, the valve plate may include a second valve plate 1720 having a fourth orifice hole 1726 communicating the third orifice hole 1754 and the suction chamber.

Here, any one of the first valve plate 1710 and the second valve plate 1720 may be selectively applied as the valve plate.

Figure 14:
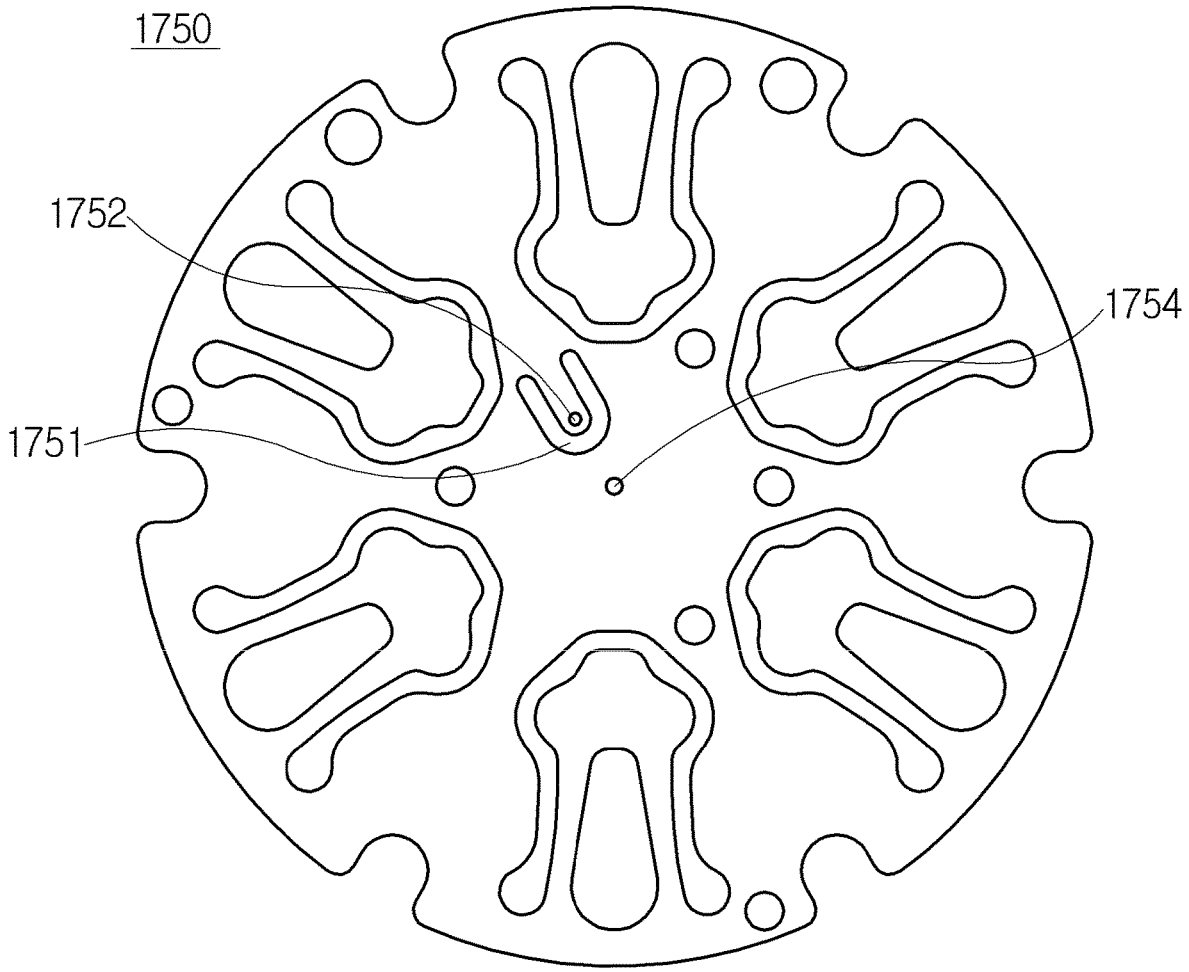
FIG. 14 is a front view illustrating a suction plate in a swash plate compressor according to another embodiment of the present disclosure.
Figure 15:
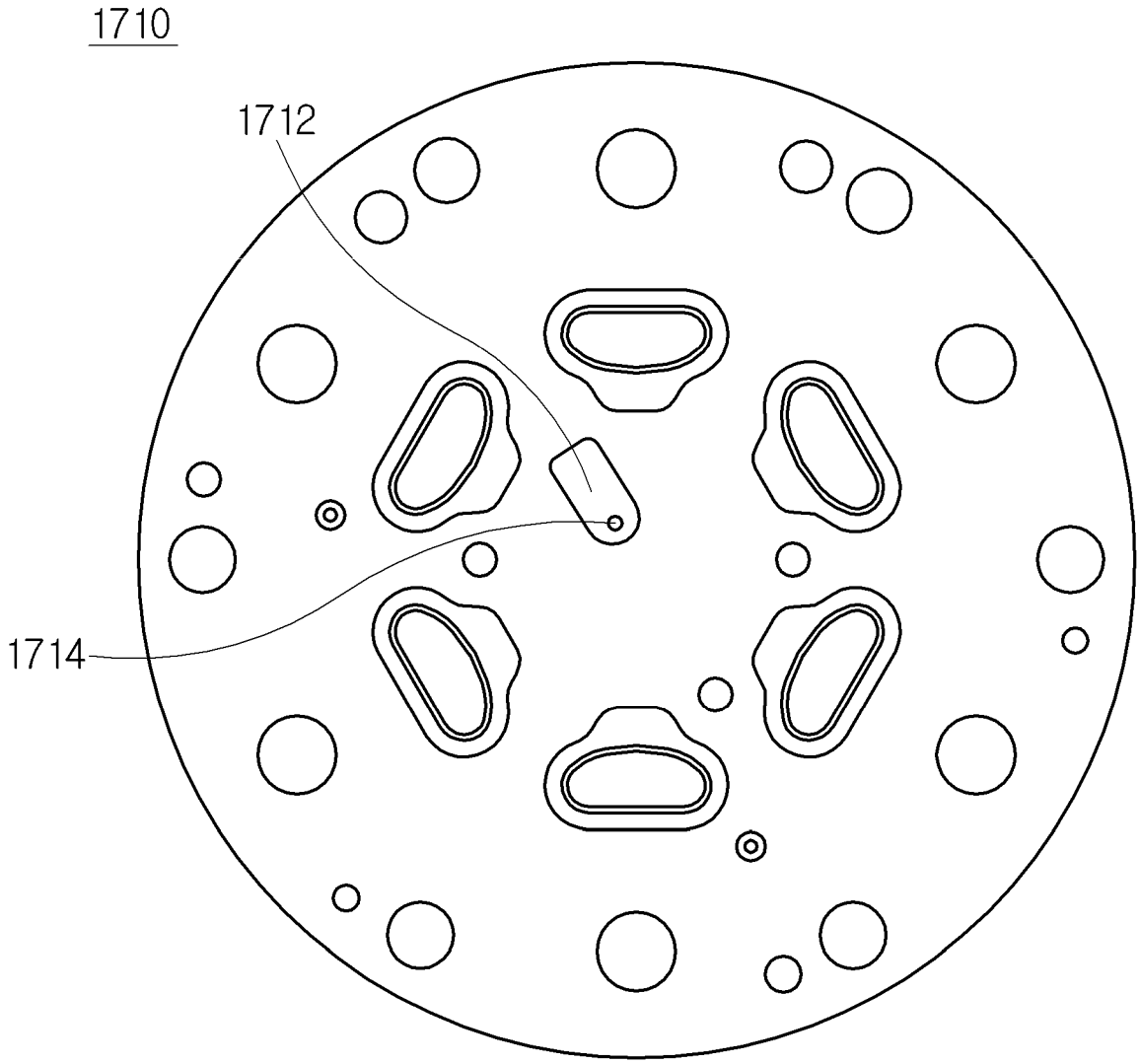
FIG. 15 is a front view illustrating a first valve plate capable of being assembled with the suction plate of FIG. 14.
Figure 17:
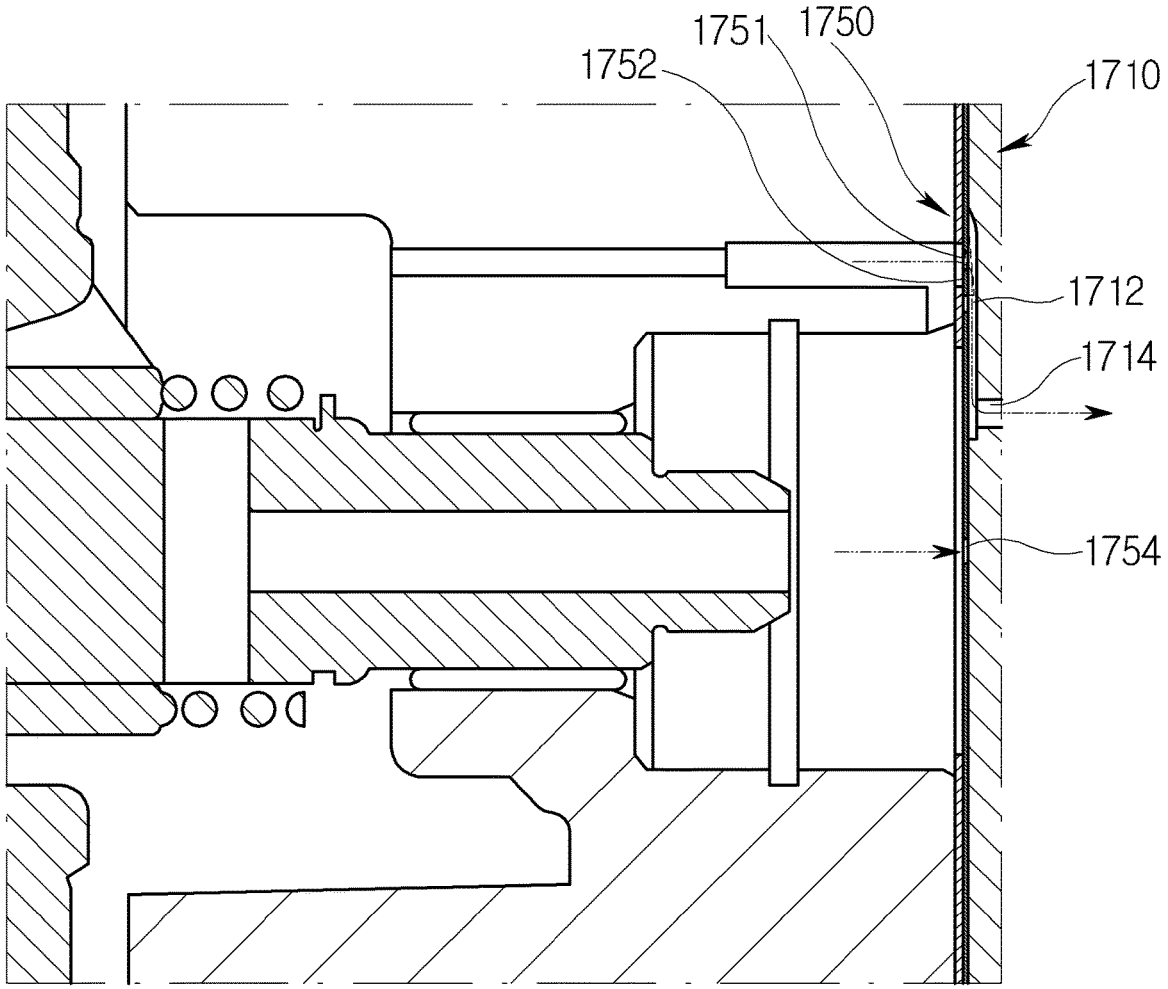
FIG. 17 is a cross-sectional view illustrating a swash plate compressor in which the suction plate of FIG. 14 and the first valve plate of FIG. 15 are assembled.

That is, when a swash plate compressor having a specification capable of adjusting the opening amount of the orifice hole is required, the first valve plate 1710 of FIG. 15 is assembled to the suction plate 1750 of FIG. 14, and as shown in FIG. 17, the refrigerant in the crank chamber may flow into the suction chamber through the first orifice hole 1751, the reed groove 1712 and the second orifice hole 1714. At this time, the third orifice hole 1754 is blocked by the first valve plate 1710, so that the refrigerant of the crank chamber may be introduced into the third orifice hole 1754, but the refrigerant of the third orifice hole 1754 may not flow into the suction chamber.

Figure 16:
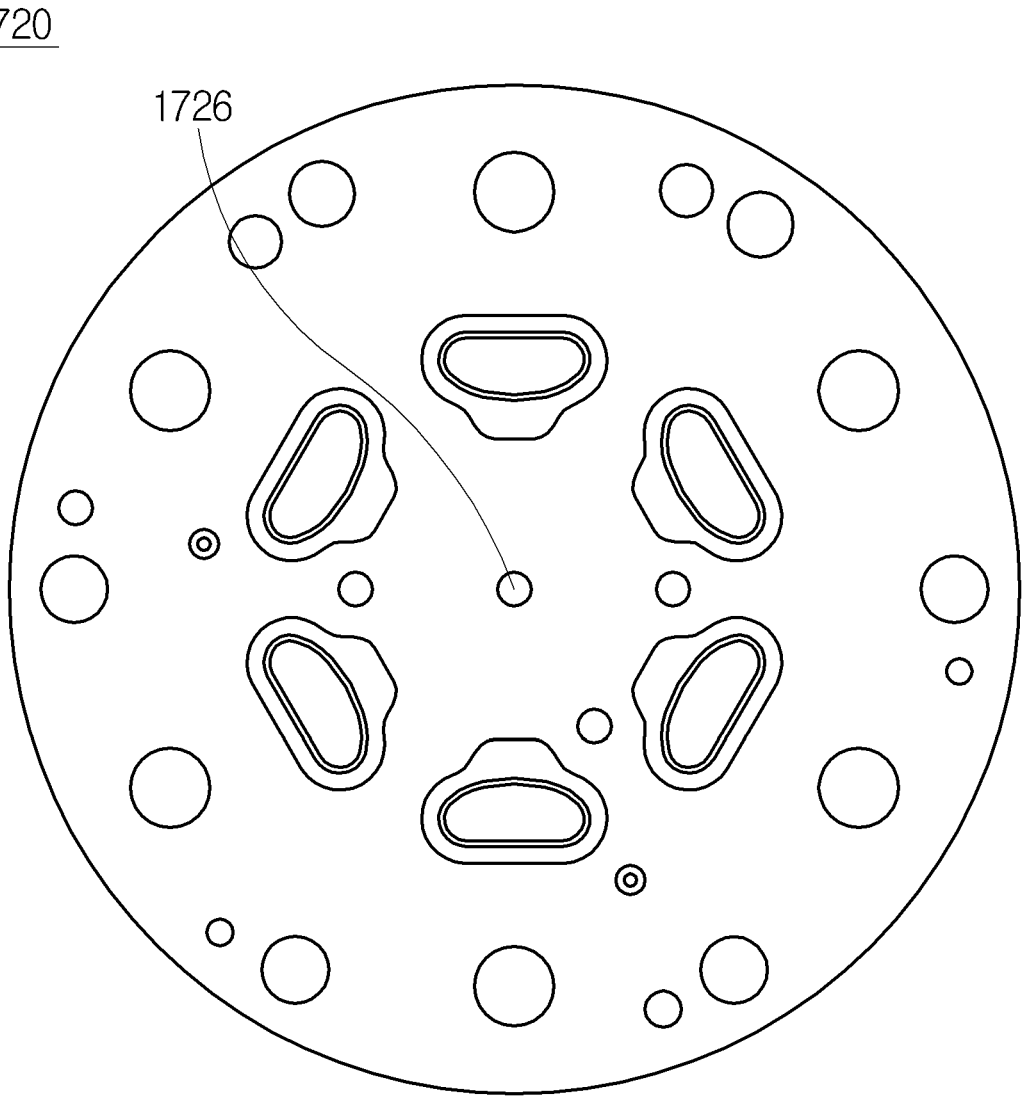
FIG. 16 is a front view illustrating a second valve plate capable of being assembled with the suction plate of FIG. 14.
Figure 18:
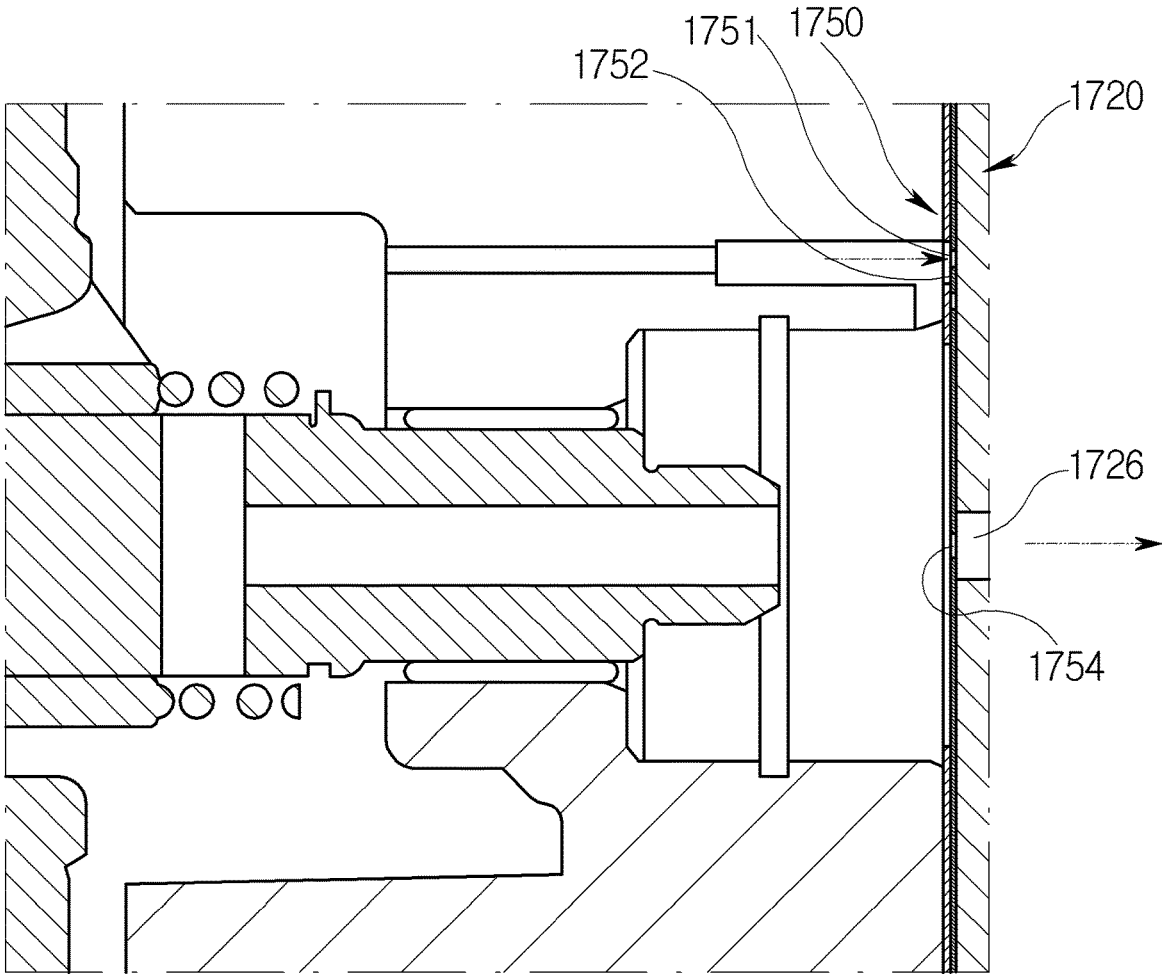
FIG. 18 is a cross-sectional view illustrating a swash plate compressor in which the suction plate of FIG. 14 and the second valve plate of FIG. 16 are assembled.

On the other hand, when a swash plate compressor having a specification that does not adjust the opening amount of the orifice hole is required, the second valve plate 1720 of FIG. 17 is assembled to the suction plate 1750 of FIG. 15 instead of the first valve plate 1710 of FIG. 16, and as shown in FIG. 18, the refrigerant of the crank chamber may flow into the suction chamber through the third orifice hole 1754 and the fourth orifice hole 1726. At this time, the first orifice hole 1751 is blocked by the second valve plate 1720, so that the refrigerant of the crank chamber may be introduced into the first orifice hole 1751, but the refrigerant of the first orifice hole 1751 may not flow into the suction chamber.

In this case, as in the above-described embodiments, it is possible to prevent a decrease in efficiency due to the orifice hole, and to increase the component sharing ratio.

Accordingly, even if the swash plate compressor of the specification capable of adjusting the opening amount of the orifice hole and the swash plate compressor of the specification that does not adjust the opening amount of the orifice hole are manufactured together in the same manufacturing line, the increase in manufacturing cost and the problem of erroneous assembly may be suppressed.

The exemplary embodiments of the present disclosure described above and illustrated in the drawings should not be construed as limiting the technical idea of the disclosure. It will be apparent to those skilled in the art that the scope of the present disclosure is limited only by the appended claims and various variations and modifications may be made without departing from the spirit and scope of the disclosure. Therefore, these variations and modifications will fall within the scope of the present disclosure as long as they are apparent to those skilled in the art.

What is claimed is:

1. A swash plate compressor comprising:

a cylinder block;

a front housing coupled to the front of the cylinder block and having a crank chamber;

a rear housing coupled to the rear of the cylinder block and having a suction chamber;

a drive shaft rotatably supported on the cylinder block;

a swash plate accommodated in the crank chamber and rotated with the drive shaft;

a piston reciprocating within a cylinder bore of the cylinder block by the swash plate; and a valve assembly for communicating and blocking the suction chamber and the cylinder bore, wherein the valve assembly comprises either a first valve plate or a second valve plate interposed between the cylinder block and the rear housing and a suction plate provided on the cylinder block side with respect to the first valve plate or the second valve plate, wherein the suction plate comprises a first orifice hole communicating with the crank chamber and a variable reed adjusting an opening amount of the first orifice hole, wherein the first valve plate comprises a second orifice hole communicating with the suction chamber and a reed groove communicating the first orifice hole and the second orifice hole, wherein the second orifice hole is formed at a position radially spaced from the variable reed, wherein the suction plate further comprises a third orifice hole formed at a position radially spaced from the first orifice hole and the variable reed, communicating with the crank chamber and having a fixed opening amount, and wherein the first valve plate is replaceable with the second valve plate comprising a fourth orifice hole communicating the third orifice hole and the suction chamber.

2. The swash plate compressor of claim 1, wherein the variable reed is configured such that one end thereof is formed integrally with the suction plate and the other end thereof extends as a free end, and is displaced within the reed groove.

3. The swash plate compressor of claim 2, wherein the variable reed is disposed to cover a portion of the first orifice hole.

4. The swash plate compressor of claim 1, wherein the cylinder block has a through-portion extending between the crank chamber and the first orifice hole.

5. The swash plate compressor of claim 1, wherein a hollow passage is formed inside the drive shaft, and the refrigerant is introduced through the hollow passage into the first orifice hole.

6. The swash plate compressor of claim 5, wherein a buffer space is formed between the hollow passage and the first orifice hole.

7. The swash plate compressor of claim 6, wherein the buffer space is formed between the cylinder block and the valve assembly.

8. The swash plate compressor of claim 1, wherein a gasket is interposed between the cylinder block and the suction plate, and the gasket comprises a gasket hole passing through the gasket at a position opposite to the variable reed.

9. The swash plate compressor of claim 8, wherein the variable reed is formed to close the gasket hole, and includes a reed hole passing through the variable reed at a position opposite to the gasket hole.

10. The swash plate compressor of claim 8, wherein the variable reed is formed such that at least a portion of the gasket hole is opened regardless of the displacement of the variable reed.

11. The swash plate compressor of claim 10, wherein one end of the variable reed is disposed within a region of the gasket hole.

12. The swash plate compressor of claim 10, wherein a portion of both ends of the variable reed is disposed within a region of the gasket hole.

* * * * *